US007011278B1

(12) United States Patent
Baldwin, III

(10) Patent No.: US 7,011,278 B1
(45) Date of Patent: Mar. 14, 2006

(54) PORTABLE LAWN BAG MOUTH HOLDER

(76) Inventor: Cedric Baldwin, III, 3282 Huelani Dr., Honolulu, HI (US) 96822

( * ) Notice: Subject to any disclaimer, the term of this patent is extended or adjusted under 35 U.S.C. 154(b) by 700 days.

(21) Appl. No.: 09/985,118

(22) Filed: Nov. 1, 2001

Related U.S. Application Data

(60) Provisional application No. 60/244,654, filed on Nov. 1, 2000.

(51) Int. Cl.
*B64B 67/04* (2006.01)

(52) U.S. Cl. ..... 248/99; 15/257.1; 15/257.7; 294/1.1

(58) Field of Classification Search ..... 248/95, 248/97, 99, 100, 101; 294/1.1, 1.4; 15/257.1, 15/257.7
See application file for complete search history.

(56) References Cited

U.S. PATENT DOCUMENTS

| | | | | |
|---|---|---|---|---|
| 1,432,486 A | | 10/1922 | Morris | |
| 1,717,717 A | | 6/1929 | Marsh | |
| 3,446,525 A | * | 5/1969 | Jones | 294/1.4 |
| 3,744,081 A | | 7/1973 | Miller | |
| 3,754,785 A | * | 8/1973 | Anderson | 294/19 R |
| 3,942,832 A | | 3/1976 | Haas, Jr. | |
| 4,010,970 A | * | 3/1977 | Campbell | 294/1.5 |
| 4,048,691 A | * | 9/1977 | Spangler | 15/257.1 |
| 4,103,953 A | * | 8/1978 | Lachance | 294/1.4 |
| 4,159,139 A | * | 6/1979 | Gawedzinski | 294/59 |
| 4,341,410 A | | 7/1982 | Summach | |
| 4,759,519 A | | 7/1988 | Cheng | |
| 4,768,742 A | | 9/1988 | Kaaloa | |
| 4,815,866 A | | 3/1989 | Martone | |
| 5,009,378 A | | 4/1991 | Linsmeyer et al. | |
| 5,183,339 A | | 2/1993 | Williams | |
| 5,588,622 A | | 12/1996 | Gordon, Sr. | |
| 5,820,179 A | * | 10/1998 | Tsou | 294/1.4 |
| 5,997,061 A | | 12/1999 | Langley | |
| 6,017,069 A | | 1/2000 | Imms et al. | |
| 6,030,010 A | | 2/2000 | Graeff | |

* cited by examiner

*Primary Examiner*—Korie Chan
(74) *Attorney, Agent, or Firm*—James Creighton Wray; Meera P. Narasimhan

(57) ABSTRACT

The present invention is a portable spring-loaded bag holder, workable with a single hand, that securely holds open the mouth of a lawn bag. Parallel handles are gripped and squeezed together in one hand. When the handles are squeezed together, a spring is compressed and a small section of frame is repositioned near a large frame loop. While the holder is held with one hand, the loop is placed within the mouth of a lawn bag, and the top of the mouth of the bag is placed over the small frame with the other hand. Releasing either the inner handle or the outer handle allows the spring to move the inner handle away from the outer handle and to move the small frame away from the large frame loop, thereby tensioning the mouth of the bag around the large loop and the small frame. The placing of the bag on the frame is quickly and easily accomplished in three steps: squeezing the handles, inserting the large loop frame in the mouth of the bag while placing the upper portion of the mouth over the small frame, and then releasing the handles.

23 Claims, 3 Drawing Sheets

PORTABLE LAWN BAG MOUTH HOLDER

BACKGROUND OF THE INVENTION

This application claims the benefit of U.S. Provisional Application No. 60/244,654, filed Nov. 1, 2000.

The present invention relates generally to the disposal of leaves and other such yard debris.

Once leaves have been raked into a pile, it is difficult to hold open the mouth of a lawn bag and to simultaneously put the leaves into the lawn bag.

There are some conventional devices for holding open garbage bag mouths. However, those devices are deficient because of lack of portability and/or lack of efficacy, due to puncturing of the bag or requiring both hands for operation.

Needs exist for improved lawn bag holders, particularly for single-handed operation.

SUMMARY OF THE INVENTION

The present invention is a Leaf Loader which is a portable spring-loaded bag holder, workable with a single hand, that securely holds open the mouth of a lawn bag.

In a preferred embodiment, parallel handles are gripped and squeezed together in one hand, which pushes the outer handle toward the inner handle. When the handles are squeezed together, a spring is compressed and a small section of frame is repositioned near a large frame loop. While the holder is held with one hand, the loop is placed within the mouth of a lawn bag, and the top of the mouth of the bag is placed over the small frame with the other hand. Releasing either the inner handle or the outer handle allows the spring to move the inner handle away from the outer handle and to move the small frame away from the large frame loop, thereby tensioning the mouth of the bag around the large loop and the small frame. The placing of the bag on the frame is quickly and easily accomplished in three steps: squeezing the handles, inserting the large loop frame in the mouth of the bag while placing the upper portion of the mouth over the small frame, and then releasing the handles.

In preferred embodiments the large looped frame and the small curved frame are made of outwardly concave suitable material such as, but not limited to, plastic or aluminum channels.

The portable holder has a large bell-shaped loop frame. A pole, having first and second ends, is positioned near the same plane as the large bell-shaped loop frame, and is attached at the first end to the large bell shaped loop frame. A small curved frame is positioned near the same plane as the large bell-shaped loop frame. A sliding mount attached to the small curved frame surrounds the pole but is not attached to the pole. A compression spring is wrapped around the first end of the pole that is attached to the large bell-shaped loop frame. The spring, in an extended position, urges the sliding mount and small curved frame away from the large bell-shaped loop frame.

A fixed position lower handle is connected generally perpendicular to the pole. A sliding upper handle is connected to the sliding mount generally perpendicular to the pole and parallel to the fixed position lower handle. The sliding handle is located near an end of the pole that is opposite from the large bell-shaped loop frame. The sliding upper handle, when moved toward the fixed position handle, compresses the spring and thereby moves the small curved frame closer to the large bell-shaped loop frame.

An alternate holder has a large bell-shaped loop frame. A pole, generally in the same plane as the large bell-shaped loop frame, has its first end attached to the large bell-shaped loop frame. A small curved frame, generally in the same plane as the large bell-shaped loop frame, slides along the pole. The small curved frame is located at a distance of, for example, about six inches from the end of the pole to which the large bell-shaped loop frame is attached.

A compression spring is coiled around the end of the pole that is attached to the large bell-shaped loop frame. The spring, when in its extended position, separates the small curved frame from the large bell-shaped loop frame by about six inches. A sliding tubular handle surrounds the pole, but is not attached to the pole. The tubular handle is attached to the small curved frame on the side of the small curved frame that is opposite from the spring that separates the small curved frame from the large bell-shaped loop frame.

The bag holder facilitates the placement of leaves or debris into the mouth of a lawn bag. A user places a bag on the ground and lifts the top edge of the mouth. The user's other hand grips the sliding handle and directs the bottom of the loop into the bag mouth. Sliding the spring-loaded handle downward positions a large circular frame and a small curved frame adjacent to one another. The top of the mouth of the lawn bag is positioned around the small curved frame, and the large circular frame is positioned within the mouth of the bag. Releasing downward force on the spring-loaded sliding handle moves the small curved frame some distance from the large circular frame and thereby stretches taut the mouth of the bag over the frames. The frames hold the mouth of the bag open. The pole or handle is held with one hand, while leaves or debris are raked or swept into the bag with the other hand.

These and other objects and features of the invention are apparent in the disclosure, which includes the above and ongoing written specification, with the claims and drawings.

DETAILED DESCRIPTION OF THE PREFERRED EMBODIMENTS

Figure 1:
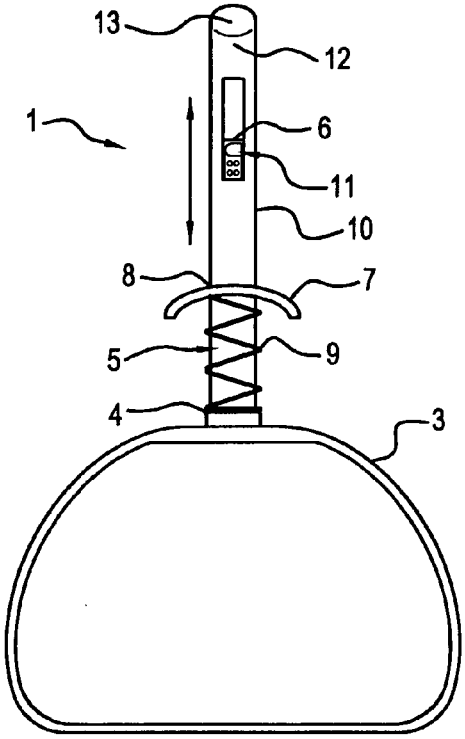
FIG. 1 is a front view of an embodiment of a bag holder.

With reference to the drawings, wherein like reference characters designate like or corresponding parts throughout the several views, there is shown a holder 1 for a plastic lawn bag.

The holder preferably comprises a large bell-shaped loop frame 3. The frame 3 is attached to the end 4 of a pole 5. A small curved frame 7 is attached to one end of a tube 10 which slides on and surrounds pole 5, but which is not attached to pole 5. The small curved auxiliary frame resides at a distance of about six inches from the large bell-shaped loop frame 3. A compression spring 9 is coiled around the end 4 of the pole 5 that is attached to the large bell-shaped loop frame 3. The spring 9, when in its extended position, serves to separate the small curved auxiliary frame 7 from the large bell-shaped frame 3.

A fixed-position lower handle 11 is attached to the pole 5 at some distance from the end 6 of the pole 5 that is opposite from the end 4 of the pole that is attached to the large bell-shaped loop frame 3. A sliding upper handle 13 is attached to an end 12 of the tube 10, whose opposite end 8 is attached to the small curved auxiliary frame 7. All of the upper handle 13, the tube 10, and the auxiliary frame 7 move relative to the pole 5 and the large bell-shaped loop frame 3.

Figure 7:
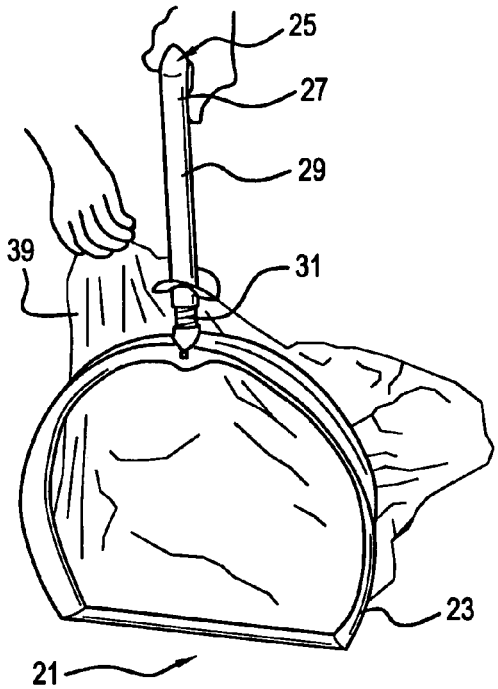
FIGS. 7–12 demonstrate a debris loading method using the holder of FIGS. 5 and 6.
Figure 8:
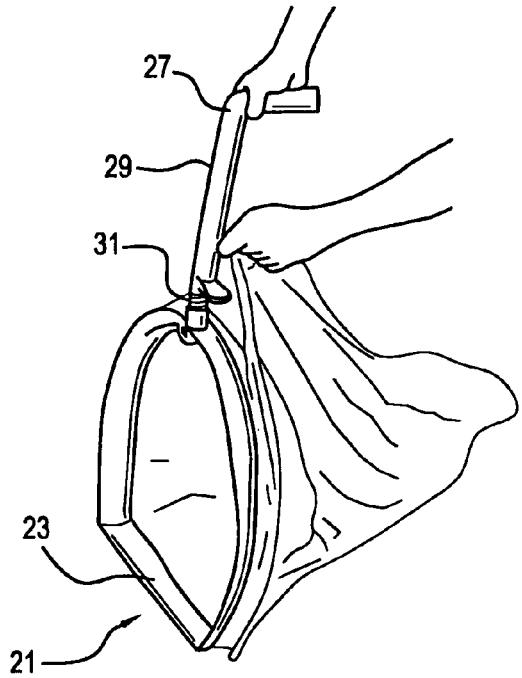
Figure 9:
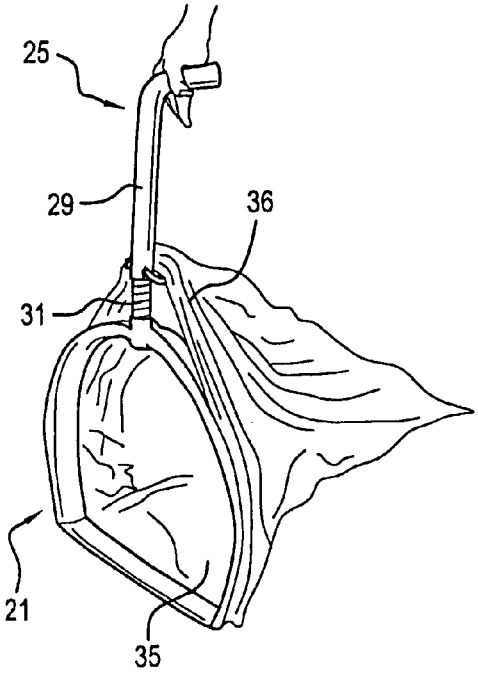
Figure 10:
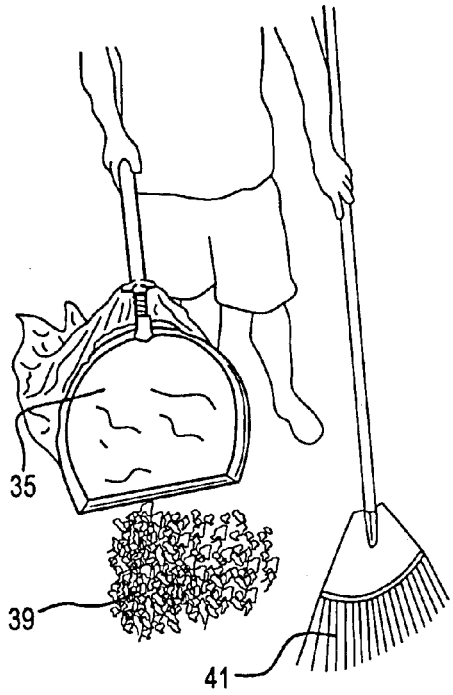
Figure 11:
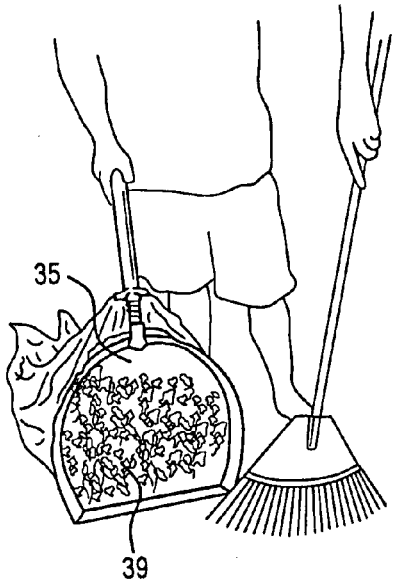
Figure 12:
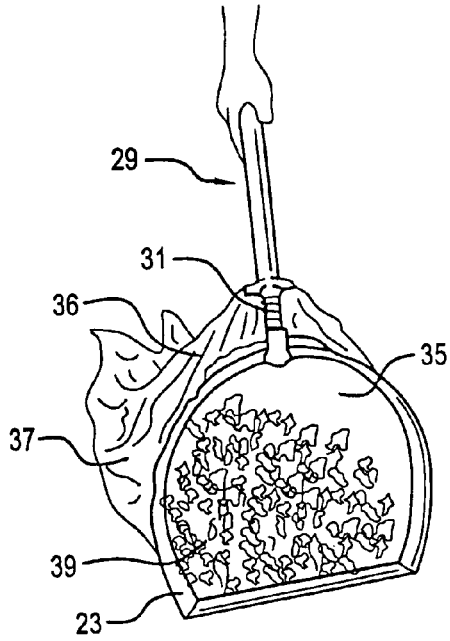

The sliding upper handle 13 and the fixed lower handle 11 are grasped and moved toward each other. The spring 9 is thereby compressed, and the small curved auxiliary frame 7 and the large bell-shaped loop frame 3 are moved adjacent to each other. The small curved auxiliary frame 7 and the large bell-shaped loop frame 3 are then placed within the mouth of a lawn bag (see FIG. 7). Subsequently, when either the sliding upper handle 13 or the fixed lower handle 11 is released, the force of the spring 9 moves the small curved frame 7 and the bell-shaped frame 3 away from one another, thus stretching taut and holding the mouth of the lawn bag. The open mouth of the bag may be controlled by one hand holding the fixed handle or pole. Leaves and debris are raked or swept into the open mouth of the bag with the other hand.

Figure 2:
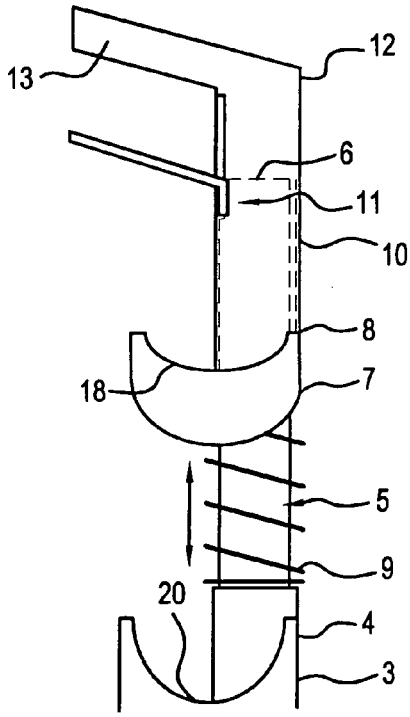
FIG. 2 is a side view of the bag holder of FIG. 1.

As shown in FIG. 2, outer surfaces 18 and 20 of the frame 3 and 7 are concave, which assists in retention of the bag mouth.

Figure 3:
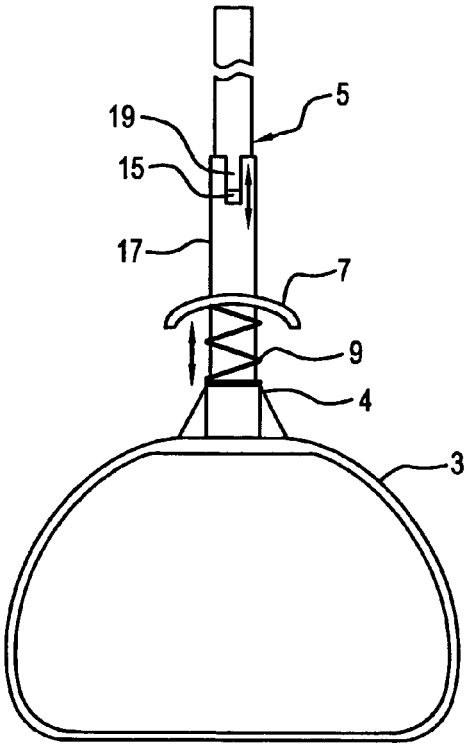
FIG. 3 is a front view of another embodiment of the bag holder.
Figure 4:
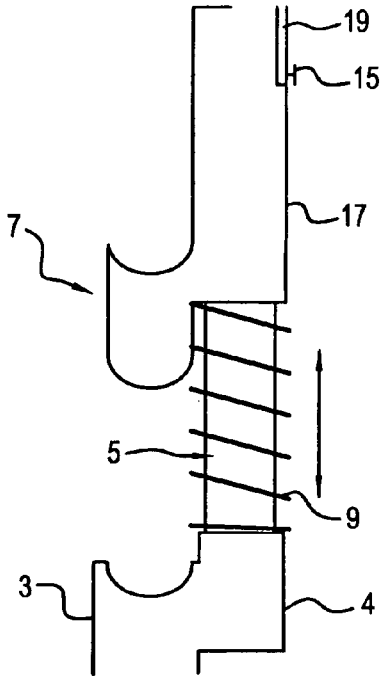
FIG. 4 is a side view of the bag holder of FIG. 1.
Figure 5:
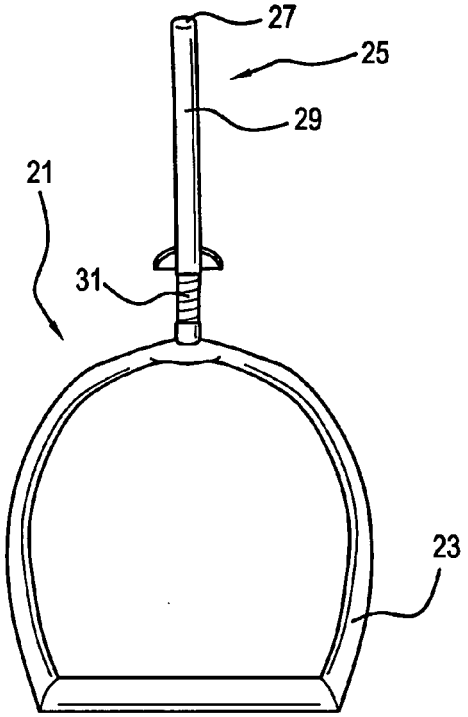
FIGS. 5 and 6 are front and side perspectives of a holder.
Figure 6:
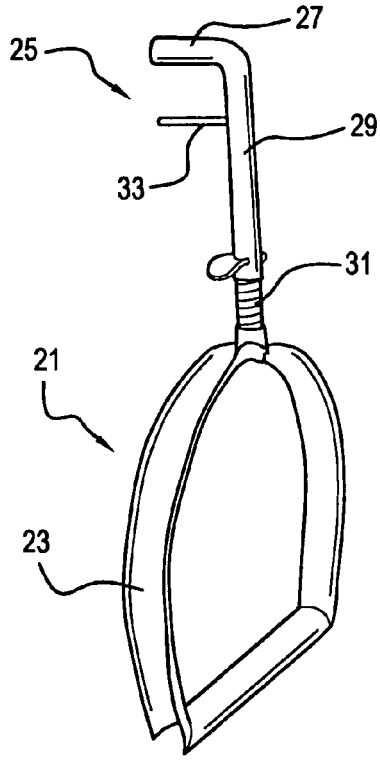

In an alternate embodiment of the invention as shown in FIGS. 3 and 4, a bag holder preferably comprises a large bell-shaped loop frame 3 that is attached to an end 4 of a pole 5. Also attached to the pole 5 at some distance from the large bell-shaped loop frame 3 is a slide support 15. Held between the slide support 15 and the large bell-shaped loop frame 3 are a slotted sliding handle 17 and a small curved auxiliary frame 7. The handle 17 surrounds the pole 5. The handle 17 and the small curved auxiliary frame 7 are attached to each other but are not attached to the pole 5. A groove 19 is formed in the handle 17. The slide support 15 fits into the groove 19. A compression spring 9 is coiled around the end 4 of the pole 5 that is attached to the large bell-shaped loop frame 3. When extended, the spring serves to separate the small curved auxiliary frame 7 from the large bell-shaped loop frame 3.

When the handle 17 is moved toward the bell-shaped frame 3, the spring 9 is compressed, and the small curved auxiliary frame 7 is moved adjacent to the large bell-shaped loop frame 3. The small curved auxiliary frame 7 and the large bell-shaped loop frame 3 are then placed within the mouth of a lawn bag (not shown). Upon release of downward force on the handle 17, the spring 9 extends and thereby separates the curved frame 7 and the bell-shaped frame 3. The mouth of the lawn bag is thereby stretched taut over the separated frames 3 and 7. The slide support 15 prevents the extension force of the spring 9 from moving the handle 17 more than a pre-determined distance away from the large bell-shaped frame 3.

The operation of a preferred Leaf Loader is shown in FIGS. 5–12. The Leaf Loader 21 consists of a lower bell-shaped frame 23 and upper handle 25 with small frame section 27 both made of suitable material such as, but not limited to, plastic. The two parts are connected by a short piece of pole 29, which may be of aluminum. Between the lower frame 23 and handle 25 is a spring 31. At the other end of the pole is a lower handle 33 which protrudes out of the upper handle body parallel to each other. When the upper and lower handles 25, 33 are squeezed the spring 31 is compressed and the small section 27 of frame 21 on the upper handle body meets with the lower frame 23. This allows the device to fit inside the mouth or opening 35 of a plastic bag, for example but not limited to, a 33–36 gallon yard clean up bag 37. The bag may be any bag, generally collapsible such as, but not limited to, trash bags, lawn bags, or other plastic bags.

The bag rim 36 is slipped around the top of the small frame section 23 on the upper handle 25. The bag rim 39 is now wrapped around the lower frame 23. When the handles 25, 33 are let go the spring loaded action pushes the upper handle 25 away from the lower frame 23 causing outward pressure or tension on the bag 37 which holds it to the frame 21 securely. Debris 39 may then be raked, swept, pushed 41 or the like, into the mouth 35 of the bag 37. Debris 39 can be any material that is to be collected and carried away such as, but not limited to, leaves, dirt, trash or the like.

While the invention has been described with reference to specific embodiments, modifications and variations of the invention may be constructed without departing from the scope of the invention, which is defined in the following claims.

I claim:

1. A portable holder for lawn bags for facilitating raking or sweeping of leaves and debris into open mouths of lawn bags, said holder comprising:

a large bell-shaped loop frame;

a pole, having first and second ends, being positioned near the same plane as the large bell-shaped loop frame, and being attached at the first end to the large bell-shaped loop frame;

a small curved frame, being positioned near the same plane as the large bell-shaped loop frame;

a sliding mount attached to the small curved frame and surrounding the pole, but not attached to the pole;

a compression spring coiled around the first end of the pole that is attached to the large bell-shaped loop frame, the spring in an extended position, urging the sliding mount and small curved frame away from the large bell-shaped loop frame;

a fixed-position lower handle connected generally perpendicular to the pole;

a sliding upper handle connected to the sliding mount generally perpendicular to the pole, parallel to the fixed-position lower handle, located near an end of the pole that is opposite from the large bell-shaped loop frame, said sliding handle, when moved toward the fixed-position handle, compressing the spring and thereby moving the small curved frame closer to the large bell-shaped loop frame.

2. The holder of claim 1, wherein the compression spring urges the sliding mount and the small curved frame away from the large bell-shaped loop frame by about six inches.

3. The holder of claim 1, wherein the fixed lower handle is fixed to the pole at a distance of about six inches from the end of the pole that is opposite from the large bell-shaped loop frame.

4. The holder of claim 1, wherein the upper and lower handles are in the same plane as the large bell-shaped loop frame.

5. A portable holder for a bag for facilitating raking or sweeping leaves and debris into the mouth of the bag, said holder comprising:

a large bell-shaped loop frame;

a pole, in the same plane as the large bell-shaped loop frame, one end of the pole being attached to the large bell-shaped loop frame;

a sliding mount surrounding the pole but not attached to the pole;

a small curved frame, fixed to the sliding mount, in the same plane as the large bell-shaped loop frame, surrounding the pole, but not attached to the pole;

a compression spring wrapped around the one end of the pole that is attached to the large bell-shaped loop frame, the spring urging the small curved frame away from the large bell shaped loop frame;

wherein the sliding mount further comprises a sliding tubular handle which surrounds the pole, but is not attached to the pole, and which is attached to the small curved frame on a side of the small curved frame that is opposite from the spring that urges the small curved frame away from the large bell-shaped loop frame.

6. The holder of claim 5, wherein the compression spring urges the sliding mount and the small curved frame away from the large bell shaped loop frame by about six inches.

7. A bag holder apparatus for holding mouth of bags open comprising a frame having a frame section and a frame loop, first and second parallel handles connected to the frame, and a compression device for allowing the first and second handles to move towards and away from each other for respectively positioning the holder within the mouth of a bag and entrapping the bag on the holder for loading material into the bag, wherein the frame section has dimensions smaller than the frame loop, wherein the loop frame is bell-shaped, further comprising a pole having first and second ends, the first end being connected to the loop frame, wherein the pole is disposed in a same plane as that of the bell-shaped loop frame, and, wherein the frame section, the pole and the bell-shaped loop frame are in the same plane.

8. The apparatus of claim 7, wherein the frame section and the loop frame are of plastic material.

9. The apparatus of claim 7, wherein the frame section and the loop frame are of aluminum material.

10. The apparatus of claim 7, wherein the frame section and the loop frame comprise outwardly concave channels.

11. The apparatus of claim 7, further comprising a sliding mount connected to the frame section and disposed around the pole.

12. The apparatus of claim 7, wherein the compression device comprises a compression spring disposed around the first end of the pole proximal the bell-shaped loop frame, the spring having an extended position for urging the sliding mount and the frame section away from the bell-shaped loop frame.

13. The apparatus of claim 7, wherein the frame section is a curved frame slidably disposed along the pole at a distance spaced from the first end of the pole proximal the bell-shaped loop frame.

14. The apparatus of claim 13, wherein the compression device is a spring coiled around the first end of the pole connected to the bell-shaped loop frame, the spring having an extended position for holding the curved frame spaced from the bell-shaped loop frame.

15. A bag holder apparatus for holding mouth of bags open comprising a frame having a frame section and a frame loop, first and second parallel handles connected to the frame, and a compression device for allowing the first and second handles to move towards and away from each other for respectively positioning the holder within the mouth of a bag and entrapping the bag on the holder for loading material into the bag, wherein the frame section has dimensions smaller than the frame loop, wherein the loop frame is bell-shaped, further comprising a pole having first and second ends, the first end being connected to the loop frame, wherein the pole is disposed in a same plane as that of the bell-shaped loop frame, further comprising a sliding mount connected to the frame section and disposed around the pole, wherein the compression device comprises a compression spring disposed around the first end of the pole proximal the bell-shaped loop frame, the spring having an extended position for urging the sliding mount and the frame section away from the bell-shaped loop frame, wherein the first handle is a fixedly disposed lower handle connected generally perpendicular to the pole and wherein the second handle is a slidably disposed upper handle connected to the sliding mount generally perpendicular to the pole and parallel to the lower handle.

16. A bag holder apparatus for holding mouth of bags open comprising a frame having a frame section and a frame loop, first and second parallel handles connected to the frame, and a compression device for allowing the first and second handles to move towards and away from each other for respectively positioning the holder within the mouth of a bag and entrapping the bag on the holder for loading material into the bag, wherein the frame section has dimensions smaller than the frame loop, wherein the loop frame is bell-shaped, further comprising a pole having first and second ends, the first end being connected to the loop frame, wherein the pole is disposed in a same plane as that of the bell-shaped loop frame, further comprising a sliding mount connected to the frame section and disposed around the pole, wherein the compression device comprises a compression spring disposed around the first end of the pole proximal the bell-shaped loop frame, the spring having an extended position for urging the sliding mount and the frame section away from the bell-shaped loop frame, wherein the first handle is a fixedly disposed lower handle connected generally perpendicular to the pole and wherein the second handle is a slidably disposed upper handle connected to the sliding mount generally perpendicular to the pole and parallel to the lower handle, wherein the upper handle is disposed at the second end of the pole away from the first end of the pole proximal the bell-shaped loop frame.

17. A bag holder apparatus for holding mouth of bags open comprising a frame having a frame section and a frame loop, first and second parallel handles connected to the frame, and a compression device for allowing the first and second handles to move towards and away from each other for respectively positioning the holder within the mouth of a bag and entrapping the bag on the holder for loading material into the bag, wherein the frame section has dimensions smaller than the frame loop, wherein the loop frame is bell-shaped, further comprising a pole having first and second ends, the first end being connected to the loop frame, wherein the pole is disposed in a same plane as that of the bell-shaped loop frame, further comprising a sliding mount connected to the frame section and disposed around the pole, wherein the compression device comprises a compression spring disposed around the first end of the pole proximal the bell-shaped loop frame, the spring having an extended position for urging the sliding mount and the frame section away from the bell-shaped loop frame, wherein the first handle is a fixedly disposed lower handle connected generally perpendicular to the pole and wherein the second handle is a slidably disposed upper handle connected to the sliding mount generally perpendicular to the pole and parallel to the lower handle, wherein the upper handle is disposed at the second end of the pole away from the first end of the pole proximal the bell-shaped loop frame, wherein the upper handle is movable toward the lower handle by compressing the spring for moving the frame section closer to the bell-shaped loop frame.

18. A bag holder apparatus for holding mouth of bags open comprising a frame having a frame section and a frame loop, first and second parallel handles connected to the frame, and a compression device for allowing the first and second handles to move towards and away from each other for respectively positioning the holder within the mouth of a bag and entrapping the bag on the holder for loading material into the bag, wherein the frame section has dimensions smaller than the frame loop, wherein the loop frame is bell-shaped, further comprising a pole having first and second ends, the first end being connected to the loop frame, wherein the pole is disposed in a same plane as that of the bell-shaped loop frame, wherein the frame section, the pole and the bell-shaped loop frame are in the same plane, wherein the frame section is a curved frame slidably disposed along the pole at a distance spaced from the first end of the pole proximal the bell-shaped loop frame, wherein the compression device is a spring coiled around the first end of the pole connected to the bell-shaped loop frame, the spring having an extended position for holding the curved frame spaced from the bell-shaped loop frame, further comprising a sliding tubular handle surrounding the pole, wherein the tubular handle is connected to the curved frame on a side of the curved frame away from the spring.

19. The apparatus of claim 18, wherein the material is selected from a group consisting of leaves, debris, dirt, and combinations thereof.

20. The apparatus of claim 18, wherein the bag is a collapsible bag selected from a group consisting of trash bags, plastic bags, and lawn bags.

21. Bag loading method comprising providing a bag on a surface for loading material, positioning a large frame loop of a bag holder in a portion near an edge of the bag, lifting another portion of the bag, pushing down on a spring-loaded handle of the bag holder positioned in a same plane as the frame loop, slidingly positioning a small curved frame adjacent to the frame loop, positioning the another portion of the bag around the curved frame, entrapping a mouth of the bag along the frame loop positioned within the mouth of the bag, forming an opening into the bag and loading material into the opening into the bag, wherein the pushing down comprises releasing a downward force on the spring-loaded sliding handle, moving the curved frame a distance from the frame loop and stretching taut the mouth of the bag over the curved frame and the frame loop, and hold the mouth of the bag open with the frames, wherein the pushing down comprises holding the handle with one hand, and wherein the loading the material comprises raking or sweeping the material into the bag with the other hand.

22. The method of claim 21, wherein the loading the material comprises loading material selected from a group consisting of leaves, debris, dirt, and combinations thereof.

23. The method of claim 21, wherein the loading the bag comprises loading a bag selected from a group consisting of trash bags, plastic bags, lawn bags, and collapsible bags.

* * * * *